US008065816B2

(12) United States Patent
Ricklefs et al.

(10) Patent No.: US 8,065,816 B2
(45) Date of Patent: Nov. 29, 2011

(54) DRYER DRUM VANE

(75) Inventors: Michael Paul Ricklefs, Webster City, IA (US); Brian Douglas Ripley, Webster City, IA (US); Steven John Joerger, Aimes, IA (US); Robin Alan Hultman, Webster City, IA (US); Charles Matthew Fischels, Webster City, IA (US); Renato Henriques Honfi, Anderson, SC (US); Melissa Michael Reim, Simpsonville, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 979 days.

(21) Appl. No.: 11/949,432

(22) Filed: Dec. 3, 2007

(65) Prior Publication Data

US 2009/0139108 A1 Jun. 4, 2009

(51) Int. Cl.
*F26B 11/02* (2006.01)

(52) U.S. Cl. ..... 34/602; 34/606; 34/610; 68/24; 68/58; D32/26; D32/29; 8/147; 8/158; 210/356; 137/512.15; 392/379; 392/384

(58) Field of Classification Search ..... 34/130, 34/137, 138, 595, 601, 602, 603, 610; 392/379, 392/384; 68/24, 58; D32/26, 29; 137/512.15; 8/147, 158; 210/356
See application file for complete search history.

(56) References Cited

U.S. PATENT DOCUMENTS 2,296,257 A * 9/1942 Breckenridge ..... 68/24
2,330,420 A * 9/1943 Haberstump ..... 68/142
2,391,634 A 12/1945 Lewis et al.
2,454,392 A 11/1948 Jorgenson
2,611,976 A 9/1952 Reiter et al.
2,827,276 A 3/1958 Racheter
3,094,860 A 6/1963 Ferrah
3,237,317 A * 3/1966 Heubsch, Sr. ..... 34/599
3,270,529 A * 9/1966 Engel ..... 68/18 F
3,320,683 A 5/1967 Worst
3,364,588 A 1/1968 Ziegler
3,388,410 A 6/1968 Marshall
3,402,576 A 9/1968 Krupsky
3,416,334 A * 12/1968 Candor et al. ..... 68/20
3,514,867 A 6/1970 Patrick (Continued)

FOREIGN PATENT DOCUMENTS

DE 4104450 A1 8/1992

(Continued)

OTHER PUBLICATIONS

Electrolux presentation entitled: FLW Vane Aesthetics, EMA and Competitors, pp. 1-19, Oct. 20, 2005.

*Primary Examiner* — Stephen M. Gravini
(74) *Attorney, Agent, or Firm* — Banner & Witcoff, Ltd

(57) ABSTRACT

A dryer has complex angled surfaces and a plurality of grip elements thereon. The angled surfaces have varying angles of inclination relative to a base of the dryer vane and the characteristics of the grip elements vary in relation to the angle of inclination of the surface portions upon which they are disposed. The grip elements may protrude from the vane surfaces and the height of the grip elements may vary in relation to the varying angle of inclination of the surfaces. Taller grip elements may be provided on the less inclined surfaces and shorter grip elements may be provided on the more inclined surfaces.

21 Claims, 9 Drawing Sheets

U.S. PATENT DOCUMENTS

| | | | | | |
|---|---|---|---|---|---|
| 3,553,850 | A | * | 1/1971 | Schuurink | 34/609 |
| 3,584,394 | A | | 6/1971 | Grabek | |
| 3,605,281 | A | | 9/1971 | Hubbard et al. | |
| 3,645,010 | A | * | 2/1972 | Korekawa | 34/599 |
| 3,729,834 | A | * | 5/1973 | Fox | 34/139 |
| 3,733,712 | A | | 5/1973 | Smith | |
| 3,792,600 | A | | 2/1974 | Hendriksson | |
| 3,803,882 | A | | 4/1974 | Brennan | |
| 3,811,202 | A | | 5/1974 | Arendt | |
| 3,875,770 | A | * | 4/1975 | Brimer et al. | 68/23.7 |
| 3,916,232 | A | * | 10/1975 | Barone | 310/63 |
| 3,938,357 | A | | 2/1976 | Leib | |
| 4,041,614 | A | * | 8/1977 | Robinet | 34/92 |
| 4,090,061 | A | * | 5/1978 | Glucksman | 392/379 |
| 4,190,874 | A | * | 2/1980 | Pasold | 361/212 |
| 4,549,699 | A | * | 10/1985 | Thompson | 241/91 |
| 4,628,617 | A | | 12/1986 | St. Louis | |
| 4,835,993 | A | | 6/1989 | Dreher | |
| 4,881,325 | A | * | 11/1989 | Jordan et al. | 34/60 |
| 4,967,490 | A | * | 11/1990 | Berger et al. | 34/235 |
| 4,974,339 | A | * | 12/1990 | Kawamura et al. | 34/73 |
| 5,318,049 | A | * | 6/1994 | Henderson et al. | 131/290 |
| 5,371,956 | A | | 12/1994 | St. Louis | |
| 5,416,983 | A | * | 5/1995 | Moser | 34/250 |
| 5,421,103 | A | * | 6/1995 | Wunderlich | 34/599 |
| 5,463,821 | A | | 11/1995 | Gauer | |
| 5,628,122 | A | * | 5/1997 | Spinardi | 34/79 |
| D382,684 | S | | 8/1997 | Jackovin | |
| 5,724,750 | A | | 3/1998 | Burress | |
| 5,802,886 | A | * | 9/1998 | Kim | 68/142 |
| 5,901,465 | A | | 5/1999 | Boussetta et al. | |
| 6,324,771 | B1 | | 12/2001 | McAllister et al. | |
| 6,343,492 | B1 | * | 2/2002 | Seagar et al. | 68/142 |
| 6,357,473 | B1 | * | 3/2002 | Porter et al. | 137/512.15 |
| 6,463,767 | B2 | | 10/2002 | Uzkureit et al. | |
| 6,578,391 | B2 | * | 6/2003 | Seagar et al. | 68/142 |
| 6,698,107 | B2 | | 3/2004 | Song et al. | |
| 6,837,265 | B2 | * | 1/2005 | Porter et al. | 137/512.15 |
| D502,298 | S | | 2/2005 | No et al. | |
| 6,968,632 | B2 | | 11/2005 | Guinibert et al. | |
| D513,100 | S | | 12/2005 | Shin et al. | |
| 7,010,942 | B2 | * | 3/2006 | Ryu et al. | 68/19 |
| 7,065,904 | B2 | | 6/2006 | Lee et al. | |
| 7,627,960 | B2 | * | 12/2009 | Beyerle et al. | 34/602 |
| 7,644,515 | B2 | * | 1/2010 | Doh | 34/603 |
| 7,765,716 | B2 | * | 8/2010 | Kim | 34/602 |
| 7,836,607 | B2 | * | 11/2010 | Kim | 34/595 |
| 7,930,912 | B2 | | 4/2011 | Lee et al. | |
| 2002/0014095 | A1 | * | 2/2002 | Seagar et al. | 68/142 |
| 2002/0040506 | A1 | * | 4/2002 | Seagar et al. | 8/159 |
| 2002/0148507 | A1 | * | 10/2002 | Porter et al. | 137/512.15 |
| 2003/0061843 | A1 | * | 4/2003 | Ryu et al. | 68/17 R |
| 2005/0102853 | A1 | | 5/2005 | Wang | |
| 2006/0179676 | A1 | | 8/2006 | Goldberg | |
| 2009/0139108 | A1 | * | 6/2009 | Ricklefs et al. | 34/130 |
| 2009/0255145 | A1 | * | 10/2009 | Poy | 34/480 |
| 2009/0320321 | A1 | * | 12/2009 | Jergens et al. | 34/499 |

FOREIGN PATENT DOCUMENTS

| | | | | |
|---|---|---|---|---|
| DE | 4128689 | A1 | * | 3/1993 |
| JP | 01212600 | A | * | 8/1989 |
| JP | 03079971 | A | * | 4/1991 |
| JP | 03244498 | A | * | 10/1991 |
| JP | 04240494 | A | * | 8/1992 |
| JP | 05076683 | A | * | 3/1993 |
| JP | 05220298 | A | * | 8/1993 |
| JP | 05245294 | A | * | 9/1993 |
| JP | 06121898 | A | * | 5/1994 |
| JP | 06190192 | A | * | 7/1994 |
| JP | 07275584 | A | * | 10/1995 |
| JP | 07275585 | A | * | 10/1995 |
| JP | 07275586 | A | * | 10/1995 |
| JP | 08024494 | A | * | 1/1996 |
| JP | 08024497 | A | * | 1/1996 |
| JP | 08332300 | A | * | 12/1996 |
| JP | 09217941 | A | * | 8/1997 |
| JP | 10305187 | A | * | 11/1998 |
| JP | 11179100 | A | * | 7/1999 |
| JP | 2003111994 | A | * | 4/2003 |
| JP | 2004222764 | A | * | 8/2004 |
| JP | 2006000261 | A | * | 1/2006 |
| JP | 2008178726 | A | * | 8/2008 |

* cited by examiner

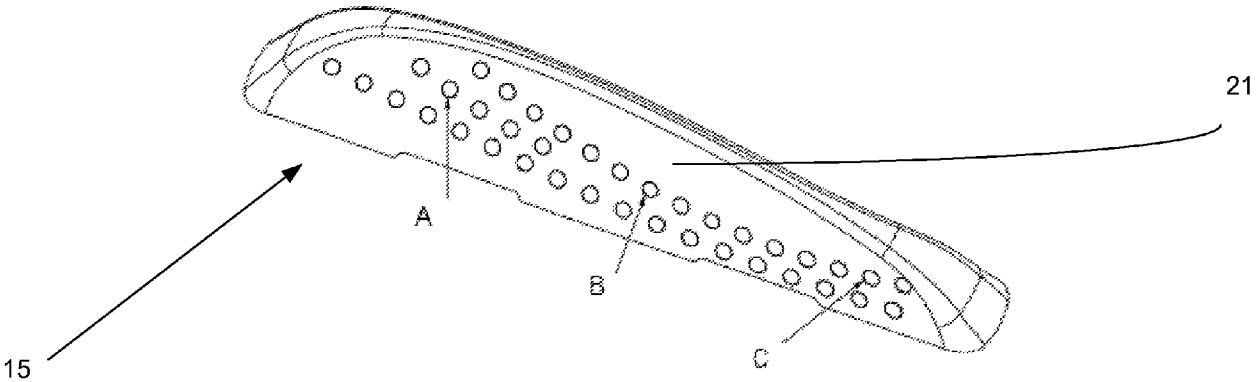
FIG. 6
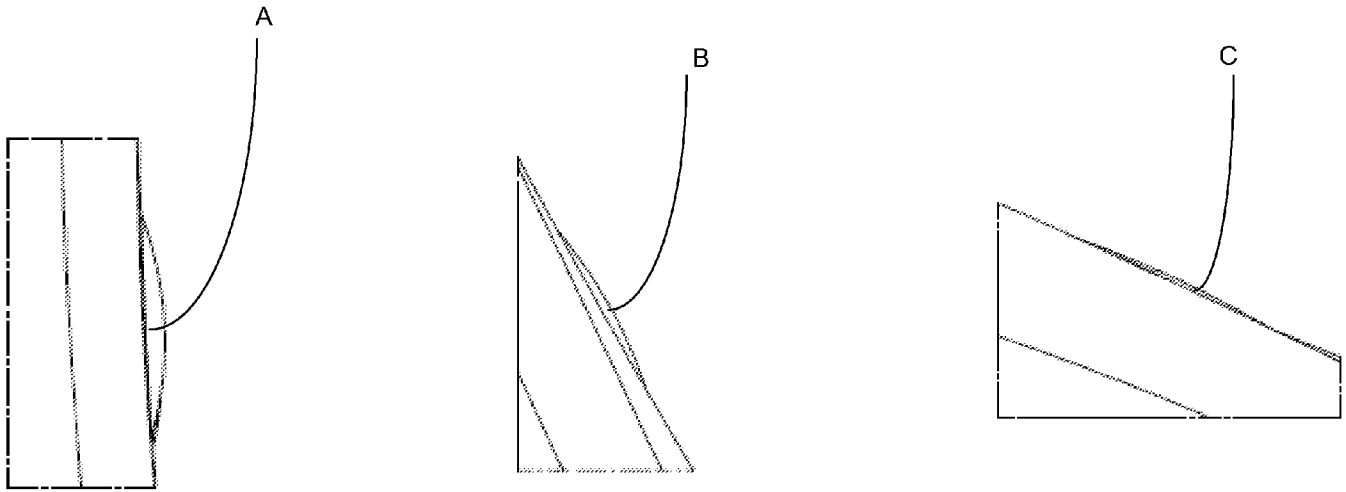
FIG. 6A
FIG. 6B
FIG. 6C

DRYER DRUM VANE

TECHNICAL FIELD

This invention relates generally to laundry dryers, and more particularly to elements mounted within a rotatable drum of the dryer for enhancing tumbling action of the laundry load within the dryer.

BACKGROUND

Automatic laundry dryers generally employ a horizontally oriented, front load rotatable dryer drum for tumbling laundry during a drying process in which air, typically heated air, is introduced into the drum. The tumbling allows for the laundry to be sufficiently exposed to the air flow and also reduces wrinkling. Conventional dryer drums contain baffles or vanes on the interior of the drum which aid in tumbling the laundry. During rotation of the dryer drum, the vanes contact the laundry and lift it to help ensure that the laundry is tumbled. Most dryer drums have vanes with straight linear configurations oriented in alignment with the rotation axis of the drum. Dryer drums, having vanes which direct clothes in the axial direction of the dryer drum have also been proposed, such as for improving air flow or to facilitate unloading. See, e.g., U.S. Pat. No. 6,698,107 to Song et al. and U.S. Pat. No. 3,364,588 to Ziegler. Such vanes generally are disposed at an angle skewed relative to the rotational axis of the dryer drum, so that the skewed face of the vane can direct the clothes axially. Mounting the vanes in a skewed manner may be more difficult than mounting the vanes in alignment with the rotation axis. Further, if the drum is installed in the dryer backwards, then the vanes would direct clothes in a direction opposite of the intended direction. Additionally, having a skewed vane configuration differing substantially in appearance from the vanes present in a matching front load washer may be less preferable to a consumer than if the vanes are similarly configured and oriented. Therefore, it would be advantageous to provide a dryer vane that can move the clothes axially without requiring a skewed mount of the vane while still ensuring that the laundry is tumbled efficiently.

SUMMARY

The present disclosure is directed to dryer drum vanes that may be mounted to extend in alignment with axial direction of the drum and yet effectively move the laundry in an axial direction of the drum during tumbling. The vanes may be configured to ensure efficient lifting of the laundry during tumbling by providing differential grip enhancement along the surface of the vane varying in relation to the varying angle of inclination of the surface.

According to one aspect of this disclosure, a dryer vane has complex surfaces and a plurality of grip elements. The complex surface portions may have varying angles of inclination relative to a base of the dryer vane and the grip elements may vary according to the angle of inclination of the complex angled surfaces upon which the grip elements are disposed. For example, the grip elements may protrude from the complex surfaces and the height of the grip elements may vary with respect to the angle of inclination of the complex surface portions from which the grip elements protrude. Taller grip elements may be provided on the less inclined surfaces and shorter grip elements may be provided on the more inclined surfaces.

In a related aspect, one or more dryer vanes are positioned on the inside of a drum of a dryer having a housing, a rotatable drum within the housing, and an air flow system which directs an air flow through the drum. The vanes may be mounted in alignment with the rotation axis of the drum.

Another aspect of this disclosure is directed to a method of increasing the efficiency of an automatic dryer which may include a dryer housing and a rotatable drum with at least one dryer vane positioned inside the drum, by directing articles in an axial direction of the drum towards a moisture sensor therein. Each of the dryer vanes has complex surfaces which have varying angles of inclination relative to a base of the dryer vane. The grip of the complex surfaces on items in the load may be enhanced by a plurality of grip elements which protrude from the complex surfaces such that the heights of the grip elements vary with respect to the angle of inclination of the complex grip surface portions from which the grip elements protrude. The operation of the dryer may be controlled based, at least in part, on information provided from the moisture sensor.

These and additional features and advantages of the invention disclosed herein will be further understood from the following detailed description.

BRIEF DESCRIPTION OF THE DRAWINGS

The foregoing summary of the disclosure, as well as the following detailed description of illustrative embodiments, is better understood when read in conjunction with the accompanying drawings, which are included by way of example, and not by way of limitation with regard to the claimed invention.

FIGS. 4A, 4B, and 4C show top, side and bottom elevation views, respectively, of the dryer vane. FIGS. 4D, 4F, 4G and 4I are perspective views of the dryer vane, while FIGS. 4E and 4H are opposite end elevation views of the dryer vane.

FIG. 6 is a further perspective view of the illustrative dryer vane.

FIGS. 6A-C are enlarged diagrammatic cross-sectional views taken at the correspondingly labeled locations in FIG. 6.

DETAILED DESCRIPTION

Figure 1:
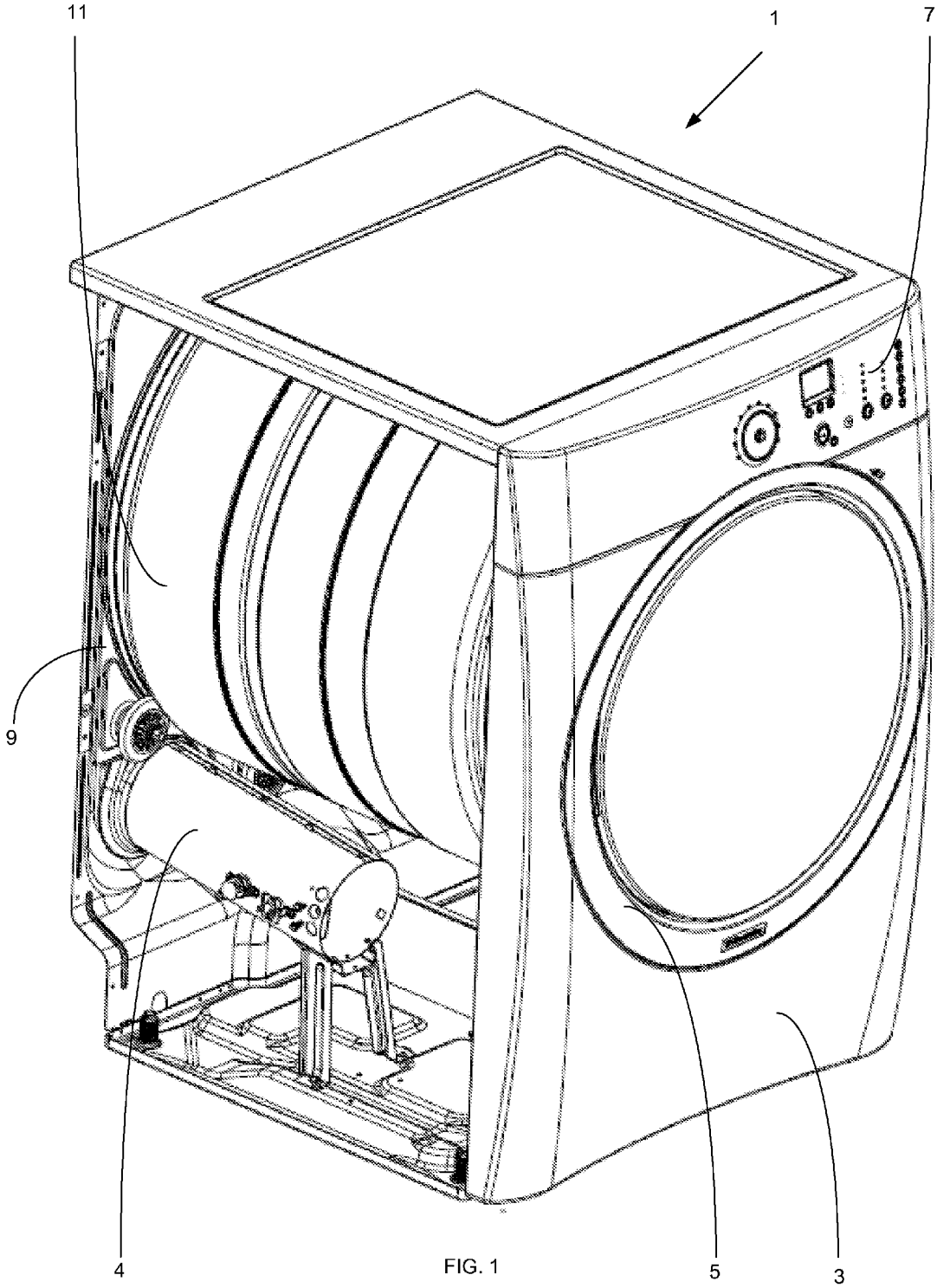
FIG. 1 is a perspective view of a laundry dryer to which aspects of the invention may be applied.
Figure 2:
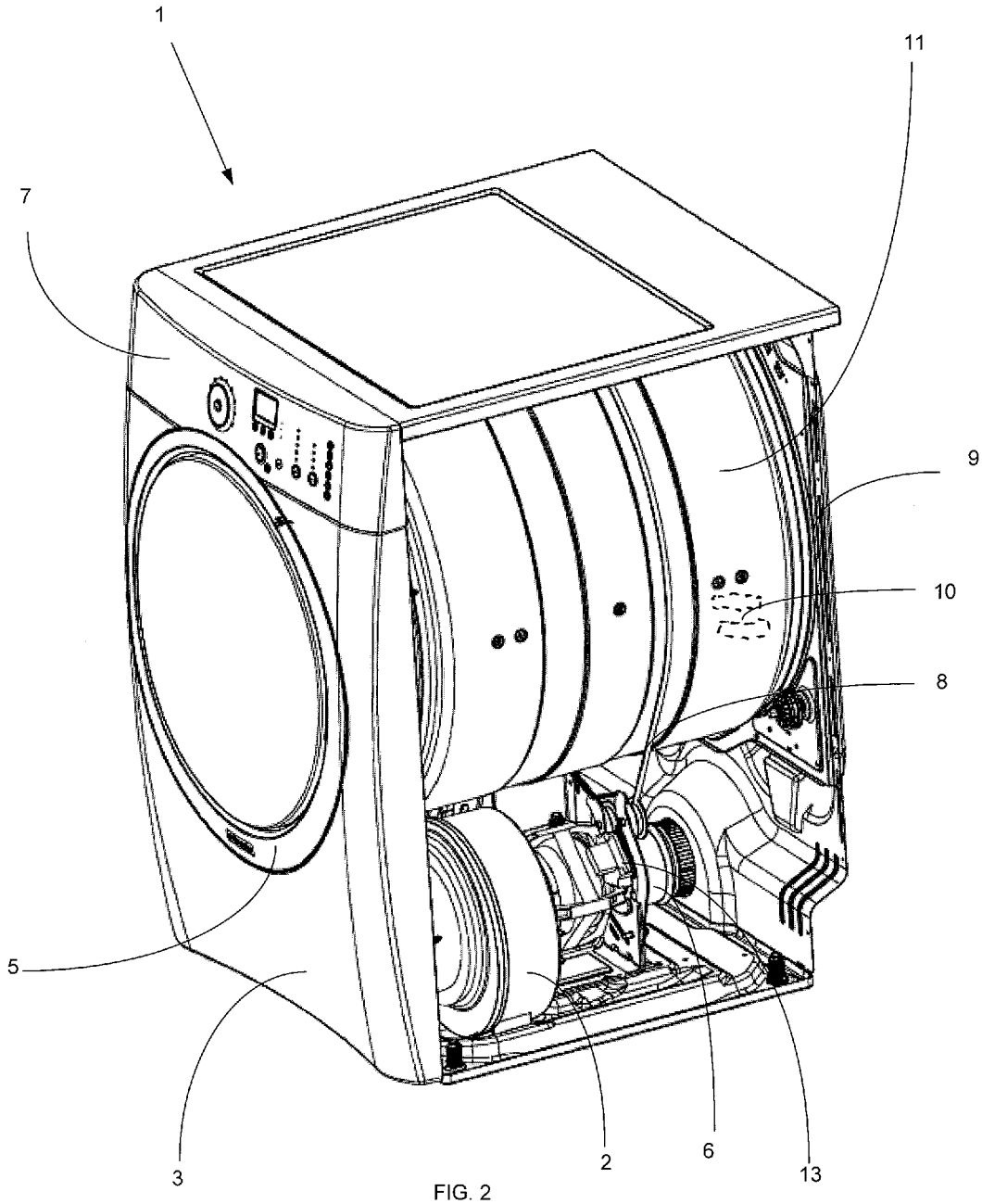
FIG. 2 schematically shows the primary internal operating components and air flow of a laundry dryer as shown in FIG. 1.

An illustrative front-load automatic laundry dryer 1 is shown in FIGS. 1 and 2. The dryer 1 includes a generally rectangular housing or cabinet 3, an access door 5 and a user interface (control panel) 7. The user interface 7 allows the user to control the operation of the dryer via such means as buttons, rotatable knobs, and lighted indicators, in a generally known fashion. It may also include a screen for displaying visual operation information to the user in a known manner. In the depicted embodiment, door 5 is circular and hinged to a front bulkhead and panel of the dryer to allow the user to open and close the door 5, to insert laundry into a drum rotatably mounted within the housing.

In a generally conventional manner, an air flow system draws air through a heater section 4 and into the drum 11 through a duct provided on the backside of a rear bulkhead 9 to which a rear side of the drum may be rotatably mounted. Preferably, air is drawn from inside of the housing into heater 4 to take advantage of heat exchange with the drum 11 and the heater. The air may be exhausted from the drum 11 through an outlet duct incorporated into the front drum-supporting bulkhead, which is concealed behind the front panel visible in FIGS. 1 and 2. A single motor 13 may be used to drive both the rotation of the drum (in forward and reverse directions), and a blower 2. Blower 2 is provided in fluid communication with the drum outlet duct, to create a vacuum causing air to flow through the system and be exhausted outside of the housing through a rearwardly extending exhaust tube 6. The drum 11 is driven by motor 13 via a belt 8.

Figure 3:
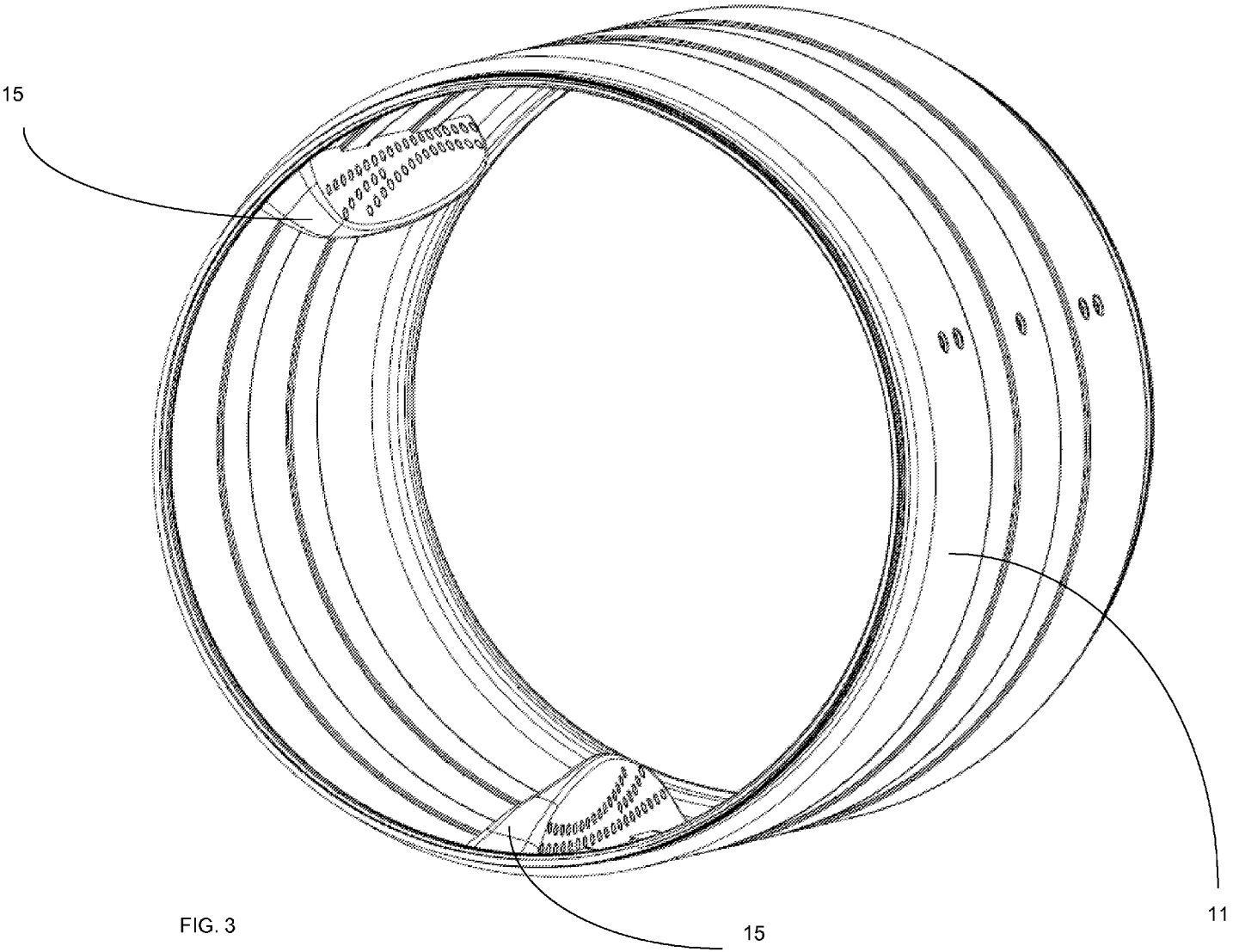
FIG. 3 is a perspective view of a drum incorporating dryer vanes according to an illustrative embodiment of the invention.
Figure 4A:
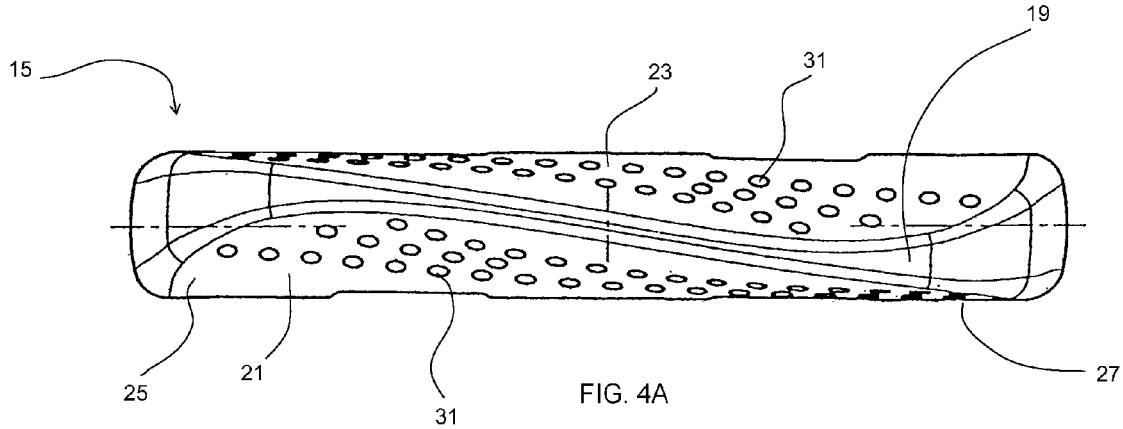
FIGS. 4A-I are various views of an illustrative embodiment of the dryer vane according to an aspect of the invention.
Figure 4B:
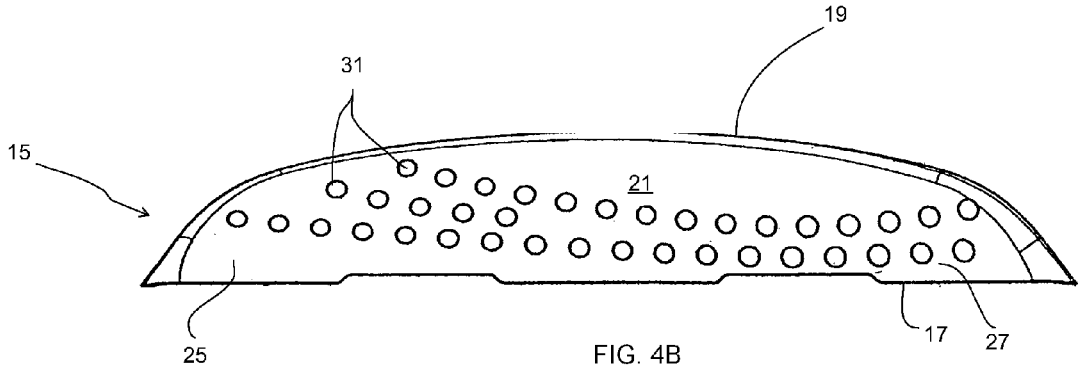
Figure 4C:
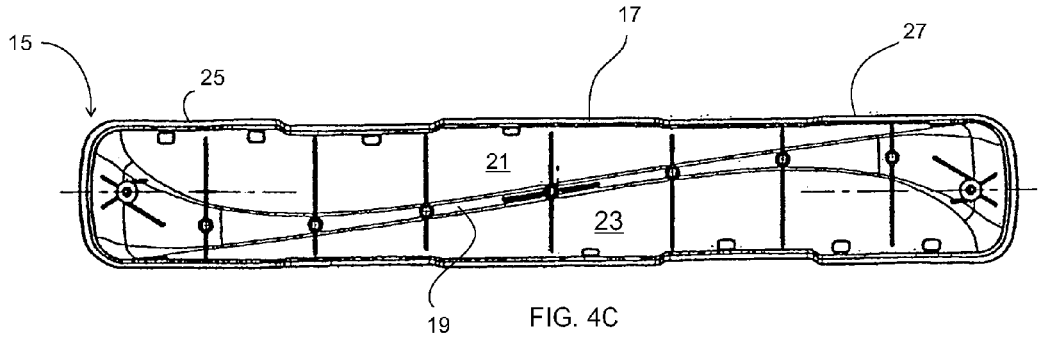
Figure 4D:
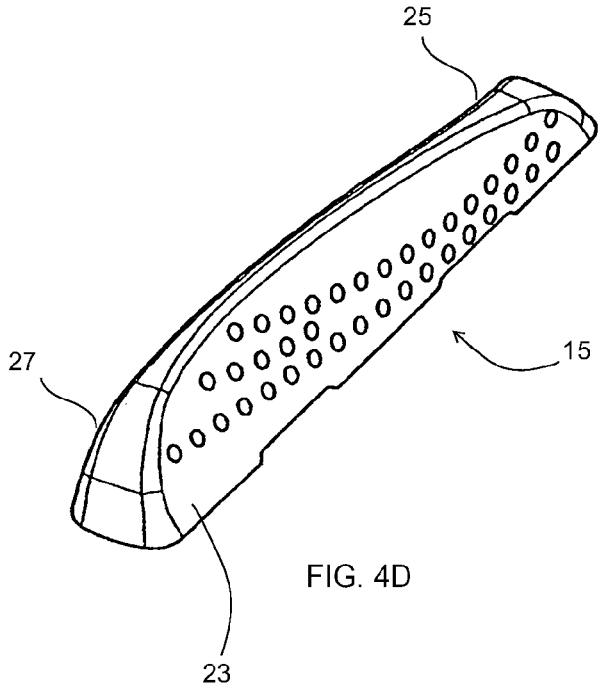
Figure 4E:
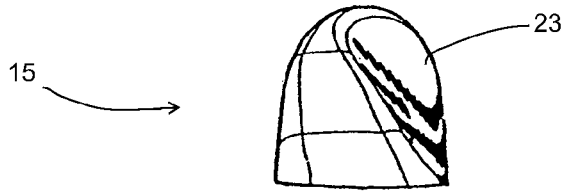
Figure 4F:
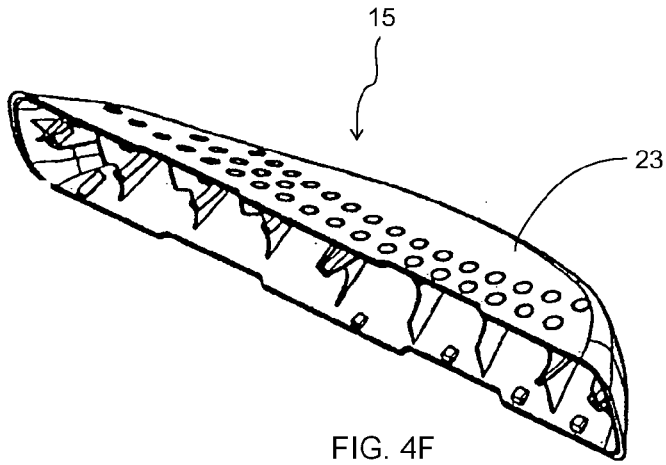
Figure 4G:
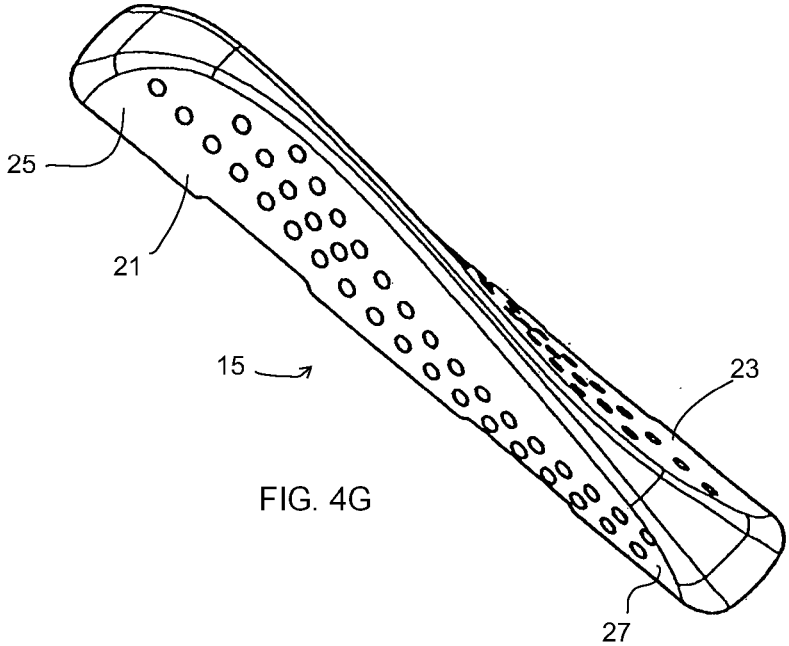
Figure 4H:
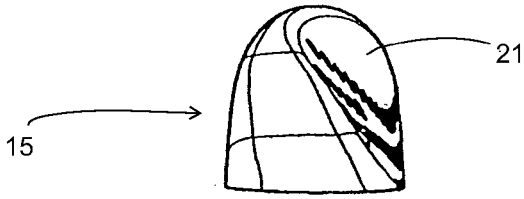
Figure 4I:
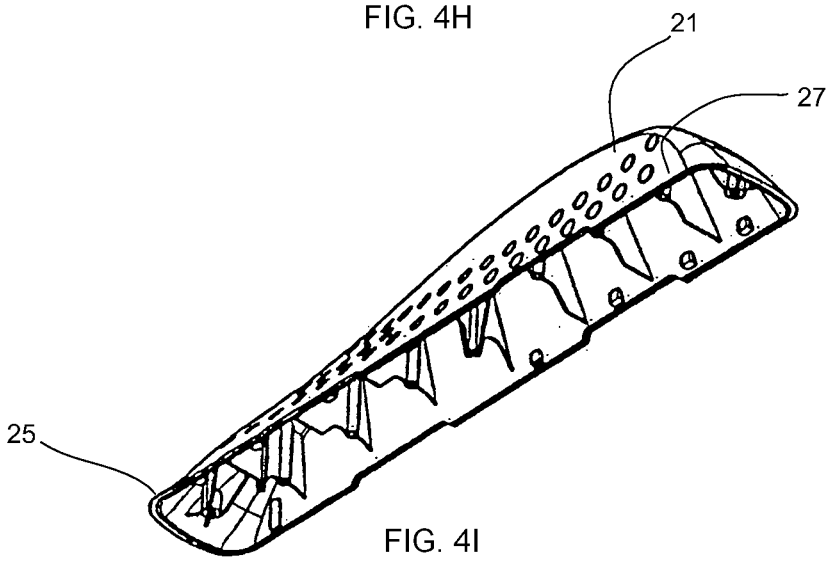

Referring now to FIG. 3, the dryer drum 11 may contain a plurality of dryer vanes 15 which are spaced regularly around the inner surface of the drum 11. In the embodiment shown in FIG. 3, three dryer vanes 15 (only 2 vanes are visible) are positioned approximately equilaterally (120 degrees apart) around the inner circumference of the dryer drum 11, in alignment with the rotation axis of the drum. As shown in FIGS. 4A-4I, illustrative dryer vane 15 is an elongated structure which is generally triangular in cross sectional shape with complex oppositely directed surfaces 21 and 23 extending up from a generally rectangular base 17 to an apex 19. Herein, "complex surface" refers to a surface extending in three dimensions and having a curvature that varies in one or more of those dimensions. As seen in FIG. 4B, dryer vane 15 has a generally linear bottom edge and an arc-shaped upper profile (varying height) extending from one lateral end to the other. As can be seen in FIG. 4A, the dryer vane 15 has a longitudinal axis and exhibits reverse symmetry about a centerline extending normal to the longitudinal axis, as well as about a longitudinal centerline of the vane.

The illustrated vane shape is just one of a virtually unlimited variety of shapes that could be used in carrying out aspects of the invention. As described herein below, an important aspect of the invention concerns varying the grip characteristics of the contact surfaces of the vane in relation to a varying angle of inclination of those surfaces.

For explanatory purposes, the surface of the vane 15 which contacts the laundry when the drum is rotated will be referred to as the leading surface, and the surface on the opposite side of the vane will be considered the trailing surface. These surfaces may be either of surfaces 21 and 23, depending on the rotation direction of the drum. The end of the vane closest to the dryer door 5 (access port) may be considered the proximal end of the vane and the end of the vane farthest from the dryer door 5 may be considered the distal end of the vane.

As seen in FIGS. 4A-4I, the illustrative vane 15 has a gentle "twist" imparted to its generally triangular cross-sectional shape. In a general sense, it is as if an elongated vane of generally triangular cross-section was distorted by gripping the vane at its ends and imparting a slight relative rotation to the surfaces above the rectangular base, or by holding the ends of the vane stationary and imparting a slight twist to the surfaces about a center point of the vane. Of course, this is not typically how the vane would be formed. Rather, more typically, the vane would be formed in the desired final shape by injection molding in a correspondingly shaped mold form (die). The opposing surfaces 21 and 23 have inclinations that vary along their lengths in a complementary fashion. For example, the inclination(s) of surface 21 at vane end 25 is equal and opposite to the inclination(s) of the rear surface 23 at the opposite vane end 27. In general, two points, one on the front surface 21 and one on the rear surface 23, which are equidistantly spaced from the center in opposite axial directions, and at the same height, will have an equal inclination (in opposite directions). Rather than extending linearly, as seen in FIG. 4A, apex 19 of the vane has a generally S-shaped curve with a center corresponding to the center of the vane and its ends flaring outwardly.

Opposing surfaces 21 and 23 also have a curvature along their lengths presenting a lateral angle of incidence that vary with respect to the generally straight edge of the base. By varying the lateral angle of incidence, the "twisted" shape of the vane 15 can, in addition to tumbling the laundry, serve to convey it in one axial direction or the other (depending on the direction of rotation), without the need to mount the vane 15 with a skew relative to the drum rotation axis.

As mentioned, the inclination or vertical slope of the facing surfaces of vane 15, varies along the length of the vane. This is best seen with reference to the various cross-sections taken along the length of the vane 15 shown in FIGS. 5A-5H. For example, it is seen that the inclination of surface 21 is relatively shallow at Section A-A (FIG. 5A) (as it is at Section H-H (FIG. 5H) for opposite surface 23.) The angle of inclination of surface 21 gets progressively larger at Sections B-B (FIG. 5B) through Section H-H (FIG. 5H) where it reaches a maximum—almost vertical—inclination. Correspondingly (and in reverse symmetrical relationship), the angle of inclination of opposite surface 23 gets progressively larger at Section H-H (FIG. 5H) through Section A-A (FIG. 5A), where it reaches a maximum—almost vertical—inclination. As seen in FIGS. 5A-5I, in the illustrated embodiment, the inclinations of the surfaces at any given section are constant, to thus provide a profile with straight sides. Recessed regions or undercuts that would complicate forming the pieces by molding are avoided in this embodiment. In other possible embodiments, the inclination angle could also vary from top to bottom.

By virtue of the varying inclination angle along the length of the vane, the lateral angles of incidence are also non-uniform. Referring again to the cross-sections of FIGS. 5A-5I, it can be seen that for any point along surface 21 above the rectangular base 17, the front-to-back spacing of the point from the corresponding edge of the base of the vane will vary in relation to the height of the point and as a function of the inclination angle. Thus, proceeding along the length of the surface along a line spaced a given distance above the base, the front-to-back displacement of the surface portion from the base edge decreases as the angle of inclination increases, effectively resulting in a skewed surface orientation that can convey load items longitudinally, with a mount of the vane in alignment with the rotation axis of the drum 11.

Since the opposing complex surfaces 21 and 23 themselves are complimentary of each other, the vane 15 exhibits reverse symmetry about both longitudinal and transverse center lines of the vane 15. Therefore, the vane may be mounted in the drum 11 without regard to the directions of the surfaces. Regardless of the end of the vane positioned to the rear of the drum, an identical arrangement of facing surfaces will be presented. With the illustrative vane embodiment, a clockwise rotation will, in addition to tumbling the laundry load, also tend to convey items of the load toward the rear of the dryer drum 11. A counterclockwise rotation will tend to convey the load forwardly within the drum 11. The front-to-back orientation neutrality of the illustrative vane simplifies assembly, since the vane can be inserted in either direction.

Axial conveyance of the laundry via the vanes 15 may serve multiple purposes. For example, as described in detail below, directing the laundry towards the rear of the drum 11 can provide more effective use of a moisture sensor 10 as diagrammatically depicted in FIG. 2, which may be provided in the form of conductive strips mounted within the drum on the rear bulk-head. The strips form an open circuit which is closed by contact with wet or damp clothing (an arrangement generally known in the art). In a typical arrangement, a controller ascertains the dryness level of the clothes based upon changes in resistance caused by contact with wet or damp clothing. By urging the pieces of the dryer load rearwardly within the drum 11 toward the moisture sensor, the accuracy of the dryness determinations can be improved. This can lead to improved efficiency of the dryer in terms of energy expended, and save the user time and expense.

Directing the laundry to the rear of the dryer drum 11 during tumbling can also serve to reduce noise and improve airflow during the operation of the dryer 1. For example, as explained earlier, in a typical arrangement, the air flowing through the dryer 1 enters through a duct at the rear (near the top rear portion of the drum) and exits though a duct at the front side (near the front lower portion of the drum). Such air flow tends to direct the laundry toward the lower portion of the front of the drum where the outlet duct grill is positioned. Therefore, the outlet duct can become clogged by the laundry. A conventional tumbling action of the drum may unclog the vent as the laundry is lifted by the vanes of the dryer. This periodic clogging and unclogging of the duct can create air flow surges that contribute a periodic noise to the overall noise generated by the operation of the dryer. Such a periodic or intermittent noise can be more objectionable than a continuous monotone noise which can be potentially "tuned out" by the user. An advantage of dryer vanes 15 according to the invention is that they can be used to direct the laundry load rearwardly away from the outlet air duct to substantially eliminate clogging/unclogging of the duct and the attendant air surge noise.

Although the complex angled vane surfaces 21 and 23 can be advantageously used to direct laundry axially and thereby provide the above described benefits, such surfaces may not, by themselves, "grip" the laundry quite as effectively as other vane styles presenting paddle-like or primarily radially directed contact surfaces which are not angled or tapered. For example, consider a vane which extends radially from the inner surface of the drum towards the center of the drum at an angle perpendicular to a tangent line of the cylindrical drum surface. In general, such a vane would be able to easily grip and lift the laundry due to its perpendicular angle.

On the other hand, as has been described, the twisted vane 15 has complex surfaces 21 and 23 including portions with varying degrees of inclination and lateral angles of incidence. Without some further provision, the complex angled surfaces 21 and 23 of the twisted vane 15 with less slope may not grip the laundry as well for tumbling as the parts of the vane with more slope. The difference in the slope along the vane 15 can affect the overall effectiveness of the vane 15 in tumbling the load. For example, end portion 25 of the angled surface 21 may not grip the laundry as well as the relatively steeper end 27 portion of the same surface 21. See, e.g., FIG. 4A-4C. The laundry will tend to slip along surface 21 more readily toward end 25 where there is less slope and therefore less grip, as compared to a surface portion adjacent end 27 where there is a greater slope and thus more grip. Further, even if the laundry were initially caught during the rotation of the drum 11 by the more vertically sloped portions of the vane 15, such as near end 27, due to the non-zero lateral angle of incidence serving to convey the load axially, the laundry will tend to be conveyed to the less vertically sloped portions of the vane 15 at the far end 25, and therefore become more prone to slipping off the vane 15 resulting in less effective tumbling.

In accordance with an aspect of the invention, grip enhancing elements 31 are added to the surface of vane 15 to alleviate such slippage and thereby improving tumbling efficiency. Preferably, the amount of grip enhancement provided is varied in at least general relation to the degree of inclination of the vane surface at any given point. One method of varying the amount of grip enhancement along the complex surfaces of the different areas of the "twisted" vane 15 is to provide the differently inclined areas with differently sized or configured gripping elements 31. This can be accomplished, for example, by providing protruding grip or traction elements 31 that vary in height, i.e., degree of protrusion from the respective inclined surface portions. For example, taller (more aggressive) grip elements 31 may be positioned in the less inclined areas of the "twisted" vane 15, while and shorter (less aggressive) grip elements 31 may be positioned on the more inclined areas of the "twisted" vane 15. Hence, in this embodiment, the height of the grip elements 31 varies in relation to the angle of inclination, or slope, of the complex vane surface upon which the grip element is mounted.

Figure 5:
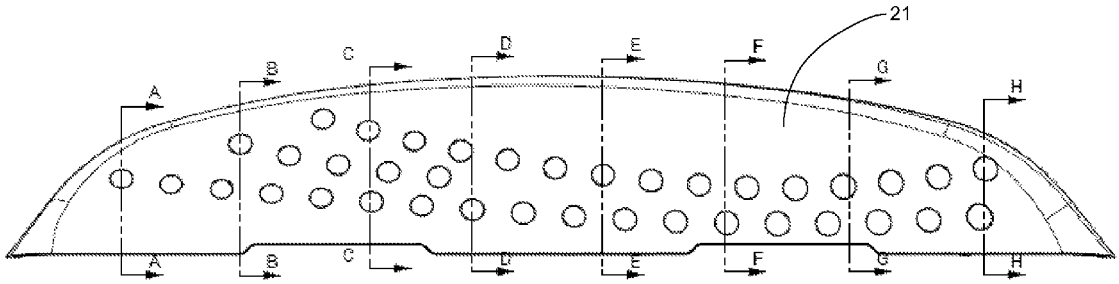
FIG. 5 is a side elevation view of the illustrative dryer vane, including section lines corresponding to the following sectional views.
Figure 5A:
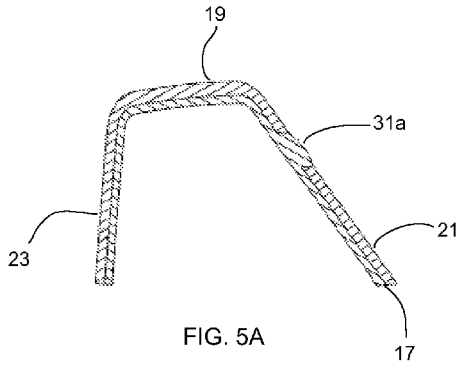
FIGS. 5A-H are various cross-sectional views of the illustrative dryer vane shown in FIG. 5, taken along correspondingly labeled section lines according to at least some aspects of the present invention.
Figure 5B:
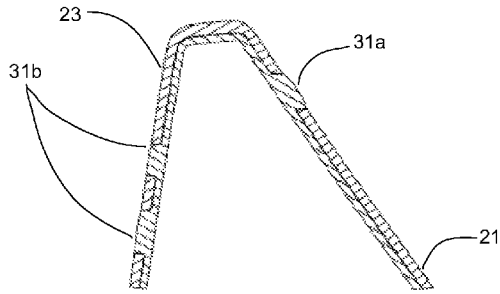
Figure 5C:
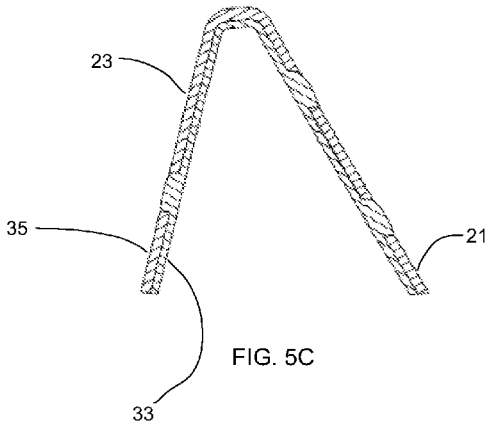
Figure 5D:
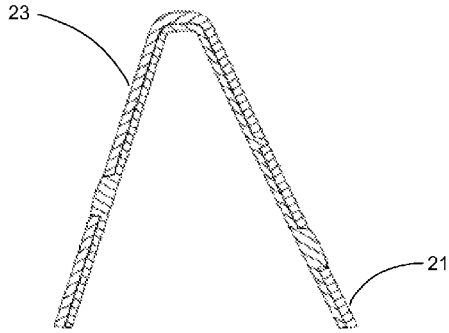
Figure 5E:
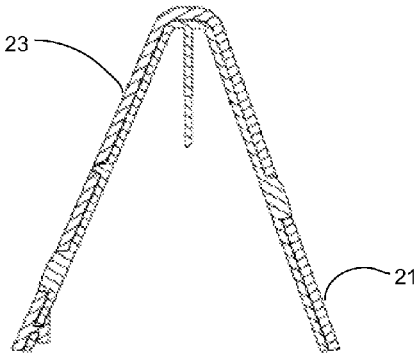
Figure 5F:
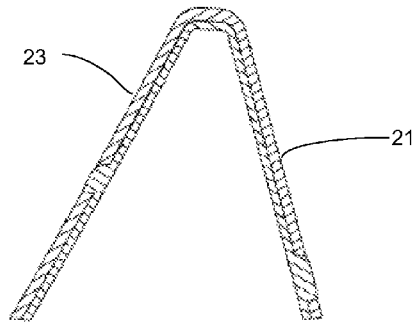
Figure 5G:
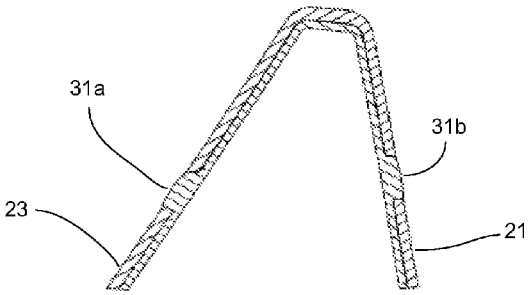
Figure 5H:
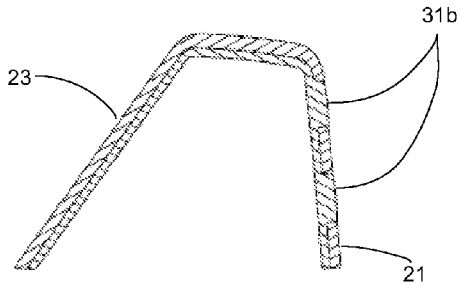

This concept is demonstrated in the illustrative embodiment shown in FIGS. 5 and 5A-H. Relatively taller protruding grip elements 31*a* are provided in the areas of the vane with less inclination or slope while shorter grip elements 31*b* are provided on the surface areas with greater inclination or slope. For example, as seen by comparing FIG. 5A and FIG. 5H, the height of the protrusion 31*a* at complex surface portion 21 shown in FIG. 5A is greater than that of protrusions 31*b* on the much steeper portion of surface 21 shown in FIG. 5H. The taller protrusions 31*a* provide more friction or gripping capability to the areas of less inclination or slope, while the shorter protrusions 31*b* provide less friction or gripping capability to the areas of greater inclination or slope. By viewing FIGS. 5A-5I in sequential order, it is seen that as complex surface 21 becomes more inclined, the grip elements 31 become shorter. Likewise, as opposite surface 23 becomes less inclined, the grip elements 31 thereon become taller or more pronounced.

As mentioned, where the slope of the vane surface is steeper, there is less need for the additional grip. By varying the heights of the grip elements in at least general relation to the slope of the vane surfaces, the gripping characteristics across the vane may be generally equalized or otherwise optimized. The heights of the grip elements may vary within a suitable range so that optimal grip along the complex surfaces is realized. It should be noted that in the illustrative embodiment shown in the drawings, the grip elements are provided with a relatively subtle variation in height, varying from being essentially flush with the surrounding surface up to a height of 0.030 inches across the length of the vane. The variation is seen more clearly with reference to FIGS. 6 and 6A-C. The enlarged diagrammatic sections (of FIGS. 6A-C) through grip elements A, B and C plainly show the height of the protrusions decreasing across the length of surface 21, as the inclination of surface 21 increases. The invention contemplates greater variations in height as well. Additional embodiments of the vanes may have grip elements with heights that may range from zero to a height greater than 0.030 inches. In one embodiment, the height is limited so as not to exceed ½ of the minor diameter or width of the element.

Varying the height of the grip elements is not the only possible method of varying the grip at the differently inclined/sloped areas of the vane 15. In one embodiment, grip elements 31 with higher coefficients of friction (which may or may not be flush with the surrounding surface) may be positioned in different areas of the vane 15. For example, in one embodiment, the grip elements 31 may be differential grip elements comprising different materials or surface textures. Also, the grip elements 31 may be of different shapes which are dictated by desired laundry gripping characteristics and/or aesthetic appearance. For example, as illustrated, the grip elements 31 have the form of raised circular protrusions, but other shapes may be provided. Further, in lieu of, or in addition to, grip elements of different heights, the grip elements 31 could be positioned in "clusters" or concentrations at particular areas to achieve differential laundry gripping effects by varying the number or density of the elements. For example, in vane areas of lesser inclination or slope there may be a concentrated "cluster" of protrusions. While at the areas of the greater inclination or slope, there may be merely a few scattered protrusions. Such clustered protrusions may also vary in height.

As can be clearly seen in FIGS. 4A, 4B and 5, the grip elements 31 can be arranged in a series of lines. The lines of grip elements may extend substantially across the length of the complex angled surfaces 21 and 23 from one end to the other. As shown, two lines extend substantially completely across complex angled surface 21 of the vane 15, while a third line extends across only a portion of the front complex angled surface 21 of the vane. Aesthetically, a particular arrangement of the grip elements 31, such as in a series of lines, can mimic an arrangement of surface features provided in a vane of a matching automatic washing machine. Commonly, washing machines and dryers are sold as a matched set. Consumers may prefer to have the appliances which are aesthetically complimentary or which have a consistent or thematic appearance. By providing grip elements 31 in a manner similar to the arrangement of holes and/or other surface features in a corresponding washer's vanes, aesthetic consistency can be obtained, in addition to the operational advantages. It will be understood that a series of lines is not required, but rather various other patterns of grip elements may be employed.

The vanes may be integrally molded as a single piece, such as by injection molding, including the grip elements 31. Alternatively, the grip elements 31 may be attached to the vane 15 after the vane has been formed. In the particular embodiment depicted in FIGS. 5B-5H, the vane 15 is formed as distinct pieces that are engaged with each other. More specifically, as shown, the vane 15 may be formed of an inner piece 33 that nests within, and is secured to, an outer piece 35. As shown in FIGS. 5A-5H, the inner piece 33 may include the grip elements 31 and be engaged with the outer piece 35 to form the dryer vane 15. In the embodiment depicted in FIG. 5A-H the grip elements 31 extend through apertures in the outer piece 35.

In light of the foregoing disclosure and description of various arrangements, those skilled in the art will readily understand that various modifications and adaptations can be made without departing from the scope and spirit of the inventions defined by the following claims.

What is claimed is:

1. A dryer vane body comprising a base for mounting the vane body within a rotatable drum of a laundry dryer, and a laundry contact surface extending from said base for carrying and tumbling laundry items as said drum rotates, said contact surface comprising at least first and second surface regions, said first region having an angle of inclination which is greater than the angle of inclination of the second region, said vane body further comprising grip enhancement features on said laundry contact surface, at least a first set of said grip enhancement features being located in said first region and at least a second set of said grip enhancement features being located in said second region, said first and second sets of grip enhancement features differing from each other so as to provide differing degrees of grip enhancement in said first and second regions.

2. The dryer vane body of claim 1, wherein each of the first and second sets of grip enhancement features comprise at least one protruding element that protrudes from the surface, the height of the protruding element in the second set being greater than the height of the protruding element in the first set.

3. The dryer vane body of claim 2, wherein a plurality of protruding elements are included in each of said first and second sets, the heights of the protruding elements in the second set being greater than the heights of the protruding elements in the first set.

4. The dryer vane body of claim 1, wherein the angle of inclination of the laundry contact surface varies along a longitudinal direction of the vane.

5. The dryer vane body of claim 4, wherein said surface comprises a complex surface presenting continuously varying angles of inclination along at least a portion of said laundry contact surface.

6. The dryer vane body of claim 5, wherein the grip enhancement features comprise protruding elements that protrude from said complex surface, the height of the protruding elements generally increasing along a longitudinal direction of the complex surface, as said angle of inclination of said laundry contact surface decreases.

7. The dryer vane body of claim 1, wherein said second set of grip enhancement features collectively provides a greater degree of grip enhancement than said first set of grip enhancement features.

8. The dryer vane body of claim 5, further comprising a generally oppositely directed second laundry contact surface on an opposite side of said vane body.

9. The dryer vane body of claim 8, said second laundry contact surface being arranged and configured on said body in substantial reverse symmetrical relationship with said first laundry contact surface.

10. The dryer vane body of claim 8, wherein the dryer vane body is generally triangular in cross section, said first and second laundry contact surfaces extending up from the base to an apex.

11. The dryer vane body of claim 10, wherein said apex extends arcuately along the length of the vane body in a general S-shape.

12. The dryer vane body of claim 10, wherein the vane body exhibits reverse symmetry about a center line of the vane body normal to the longitudinal axis of the of the vane body.

13. The dryer vane body of claim 12, wherein the vane body further exhibits reverse symmetry about a longitudinal centerline of the vane body.

14. A laundry dryer comprising:

a housing;

a drum rotatably mounted within the housing;

a drive system for rotatably driving the drum;

an air flow system which generates an air flow through the drum; and a plurality of dryer vanes positioned in spaced relationship about an interior surface of the drum, each of the dryer vanes including a base mounting the vane body to said interior surface of the drum, and a laundry contact surface extending from said base for carrying and tumbling laundry items as said drum rotates, said contact surface comprising at least first and second surface regions, said first region having an angle of inclination which is greater than the angle of inclination of the second region, said vane body further comprising grip enhancement features on said laundry contact surface, at least a first set of said grip enhancement features being located in said first region and at least a second set of said grip enhancement features being located in said second region, said first and second sets of grip enhancement features differing from each other so as to provide differing degrees of grip enhancement in said first and second regions.

15. The dryer of claim 14, wherein said laundry contact surface is configured to convey laundry in an axial direction of the drum during drum rotation and tumbling of a laundry load.

16. The dryer according to claim 15, wherein the dryer vanes are mounted to the drum in substantial alignment with the rotation axis of the drum.

17. The dryer of claim 15, further comprising a moisture sensor positioned to the rear of the rotatable drum, wherein the dryer vanes direct articles of the dryer load toward the rear of the rotatable drum to increase contact of said articles with said moisture sensor.

18. The dryer of claim 15, wherein the air flows through the drum from a rear portion of the drum and exits the drum at a front portion of the drum, and wherein the dryer vanes are configured to direct articles against such air flow towards the rear of the drum.

19. The dryer of claim 14, wherein each of the first and second sets of grip enhancement features comprise at least one protruding element that protrudes from the surface, the height of the protruding element in the second set being greater than the height of the protruding element in the first set.

20. A dryer vane body comprising a base for mounting the vane body within a rotatable drum of a laundry dryer, and a laundry contact surface extending from said base for carrying and tumbling laundry items as said drum rotates, said contact surface comprising at least first and second surface regions, said first region having an angle of inclination which is greater than the angle of inclination of the second region, said vane body further comprising protruding elements on said laundry contact surface, at least a first set of said protruding elements being located in said first region and at least a second set of said protruding elements being located in said second region, said first set having at least one protruding element differing in height from at least one protruding element in said second set.

21. The dryer vane body of claim 20, wherein a plurality of protruding elements are included in each of said first and second sets, the heights of the protruding elements in the second set being greater than the heights of the protruding elements in the first set.

* * * * *

UNITED STATES PATENT AND TRADEMARK OFFICE

CERTIFICATE OF CORRECTION

PATENT NO. : 8,065,816 B2
APPLICATION NO. : 11/949432
DATED : November 29, 2011
INVENTOR(S) : Michael Paul Ricklefs et al.

It is certified that error appears in the above-identified patent and that said Letters Patent is hereby corrected as shown below:

On the title page item (75), line 4:
Delete "Aimes, IA" after the Inventor Steven John Joerger and insert --Ames, IA--.

Column 8, Claim 12, line 54:
Delete the redundant (second) occurrence of "of the" after the word "axis".

Signed and Sealed this
Twelfth Day of June, 2012

David J. Kappos

David J. Kappos
*Director of the United States Patent and Trademark Office*